US008375757B2

(12) United States Patent
Suzuki

(10) Patent No.: US 8,375,757 B2
(45) Date of Patent: Feb. 19, 2013

(54) METHOD FOR SHOT PEENING AND A MACHINE THEREFOR

(75) Inventor: Hiroaki Suzuki, Toyokawa (JP)

(73) Assignee: Sintokogio, Ltd., Aichi (JP)

( * ) Notice: Subject to any disclaimer, the term of this patent is extended or adjusted under 35 U.S.C. 154(b) by 424 days.

(21) Appl. No.: 12/673,107

(22) PCT Filed: May 29, 2008

(86) PCT No.: PCT/JP2008/059905

§ 371 (c)(1),
(2), (4) Date: Feb. 11, 2010

(87) PCT Pub. No.: WO2009/022489

PCT Pub. Date: Feb. 19, 2009

(65) Prior Publication Data

US 2011/0097972 A1 Apr. 28, 2011

(30) Foreign Application Priority Data

Aug. 11, 2007 (JP) ..... 2007-210566

(51) Int. Cl.
*C21D 7/06* (2006.01)

(52) U.S. Cl. ..... 72/53

(58) Field of Classification Search ..... 72/53; 29/90.7; 73/11.02, 514.34, 753, 861.73
See application file for complete search history.

(56) References Cited

U.S. PATENT DOCUMENTS 4,470,292 A * 9/1984 DeClark et al. ..... 73/11.02
4,552,017 A * 11/1985 Biehle ..... 73/198
4,614,100 A * 9/1986 Green et al. ..... 72/53
4,848,123 A * 7/1989 Thompson ..... 72/53
4,873,855 A 10/1989 Thompson
5,166,885 A 11/1992 Thompson
5,204,826 A * 4/1993 Thompson et al. ..... 702/84
5,271,282 A * 12/1993 Thompson ..... 73/862.08
5,365,762 A 11/1994 Thompson
6,640,596 B2 11/2003 Yamamoto et al.
7,040,959 B1 5/2006 Panuska et al.

FOREIGN PATENT DOCUMENTS

| | | |
|---|---|---|
| JP | 4-19071 | 1/1992 |
| JP | 4-332836 | 11/1992 |
| JP | 9-210973 | 8/1997 |
| JP | 2764663 | 4/1998 |
| JP | 2002-36114 | 2/2002 |
| JP | 2002-361560 | 12/2002 |
| JP | 2003-159651 | 6/2003 |

* cited by examiner

*Primary Examiner* — Edward Tolan
(74) *Attorney, Agent, or Firm* — Finnegan, Henderson, Farabow, Garrett & Dunner, L.L.P.

(57) ABSTRACT

A method for shot peening wherein the work is processed by being hit by shot materials that are shot by compressed air, and a machine for carrying out the method are provided. By the present invention the status of a work can be measured while the work is being processed. The requirements for maintaining and calibrating the sensor that is used for the measurement are reduced because the wear of the sensor is prevented. The method for shot peening is to process a work by shooting the shot materials with compressed air from a shooting nozzle against the work. The shooting nozzle is equipped with a transducer that detects elastic waves and transduces them to high-frequency electrical signals. The elastic waves are generated when the shot materials pass through the shooting nozzle. The characteristic values of the shot materials, which pass through the shooting nozzle, are measured and monitored based on the signals.

14 Claims, 3 Drawing Sheets

METHOD FOR SHOT PEENING AND A MACHINE THEREFOR

TECHNICAL FIELD

The present invention relates to a method for shot peening and a machine for it. Specifically it relates to a method that comprises the steps of electrically measuring and controlling the conditions of shot materials while they are being shot and a machine for carrying out the method.

BACKGROUND ART

Several conventional methods for measuring the status of works that are processed by air-type shot-peening machines are known. Methods for controlling the status while the works are being processed include one that comprises the steps of measuring the pressure for shooting and the amount of materials to be shot by means of a pressure sensor, a load cell, or a sensor for sensing the amount of passing metal, and feeding back such measurements. The methods may include the steps of controlling the grain sizes of the shot materials, detecting the rotation of a work, etc. Another method, called the "Almen method," is known. It employs a specimen to be shot instead of a work and checks whether the machine operates normally with a specimen that has been scraped.

A sensor that electrically senses the intensity of the shot peening is disclosed (see Japanese Patent Laid-open Publication No. H04-019071). It measures the impact value, or kinetic energy, and the number of hits of the shot materials.

Further, a shot-peening machine that is detachably equipped with a sensor between a nozzle to shoot the materials and a work is disclosed (see Japanese Patent No. 2764663). That sensor electrically senses the intensity of the shot peening that is achieved by the shot materials. A shot-peening machine that is detachably equipped with that sensor, and which sensor is located between the centrifugal shooting machine, which centrifugally shoots the shot materials, and a work, is also disclosed (see Japanese Patent Laid-open Publication No. H04-332836). A method for electrically sensing the intensity of the shot peening by embedding a sensor in a model of a work is also disclosed (see Japanese Patent Laid-open Publication No. 2002-036114).

DISCLOSURE OF INVENTION

However, the above-mentioned methods do not detect the actual conditions of the shot materials while they are being shot, since controlling the grain sizes of the shot materials, detecting the rotation of a work, or controlling the pressure for shooting and the amount of materials to be shot, just controls the conditions of the operation. Thus, the status of the processed work is checked by actually measuring it at regular intervals by using the Almen method, etc.

By the Almen method, a specimen is processed by shot peening before an actual work is to be processed. Then, the processed surface of the specimen is measured. The best condition for the amount of the shot materials and pressure for shooting is determined based on the results of the measurements. A controller controls the amount of the shot materials and the pressure for shooting by inputting data on that condition. Thus, no measurement can be done while an actual work is being processed.

For the machine where the sensor is detachably disposed between the nozzle to shoot the materials and a work, no measurement can be made while an actual work is being processed. In addition, because over time the sensor is worn out by shot peening, its maintenance and calibration may be required. Further, precise measurements are difficult to make, since the shot materials hit the sensor after they are reflected by it or the work that is being processed. These points are the problems.

While each work should be traced, no record of shot peening for any work is obtained by these methods.

The objectives of the present invention are to provide a method for shot peening wherein the status of shot materials can be measured while the work is being processed, and to provide a machine for carrying out the method. The work is processed by being hit by the shot materials that are shot by compressed air. The requirements for maintaining and calibrating the sensor that is used for the measurement are reduced because the wear of the sensor is prevented.

The method for shot peening is to process a work by shooting the shot materials with compressed air from a shooting nozzle against the work. The shooting nozzle is equipped with a transducer that detects elastic waves and transduces them to high-frequency electrical signals. The elastic waves are generated when the shot materials pass through the shooting nozzle. The method is characterized in that the characteristic values of the shot materials, which pass through the shooting nozzle, are measured and monitored based on the signals.

The shot-peening machine of the present invention, which is used for the method for shot peening, comprises a storage tank for shot materials, a device for adjusting the amount of the materials to be shot, a device for adjusting the pressure of the compressed air to be used for shooting the materials, a shooting nozzle to shoot the materials, a transducer to transduce elastic waves to high-frequency electrical signals, and a controller. The shooting nozzle shoots the materials by the compressed air, the pressure of which is adjusted by the device for doing so. The materials are supplied from the device for adjusting the amount of materials to be shot through a means for transporting the materials. The transducer, which is located in the shooting nozzle, detects the elastic waves that are generated by the materials that pass through the shooting nozzle. The controller is electrically connected to the transducer, to the device for adjusting the amount of materials to be shot, and to the device for adjusting the pressure of the compressed air. It comprises a circuit for measuring the characteristic values of the materials that pass through the shooting nozzle. The measurement is based on the high-frequency electrical signals from the transducer. It also comprises a controlling means for monitoring the characteristic values.

By the present invention, since the transducer that detects elastic waves and transduces them to high-frequency electrical signals is located in the shooting nozzle, the condition of the shot materials can be measured while the work is being processed. Unlike the conventional method and machine, since no materials hit the sensor after being reflected to it, the status of the shot materials can be measured more precisely than in that prior-art method and machine. In addition, since the sensor is not hit by the materials, it can be used for the life of the shooting nozzle. Thus, the requirements for maintenance and calibration are reduced. So, the cost can be reduced.

The basic Japanese Patent Application, No. 2007-210566, filed Aug. 11, 2007, is hereby incorporated by reference in its entirety in the present application.

The present invention will become more fully understood from the detailed description given below. However, the detailed description and the specific embodiment are only illustrations of desired embodiments of the present invention, and so are given only for an explanation. Various possible changes and modifications will be apparent to those of ordinary skill in the art on the basis of the detailed description.

The applicant has no intention to dedicate to the public any disclosed embodiment. Among the disclosed changes and modifications, those which may not literally fall within the scope of the present claims constitute, therefore, a part of the present invention in the sense of the doctrine of equivalents.

The use of the articles "a," "an," and "the" and similar referents in the specification and claims are to be construed to cover both the singular and the plural, unless otherwise indicated herein or clearly contradicted by the context. The use of any and all examples, or exemplary language (e.g., "such as") provided herein, is intended merely to better illuminate the invention, and so does not limit the scope of the invention, unless otherwise claimed.

BEST MODE FOR CARRYING OUT THE INVENTION

Figure 1:
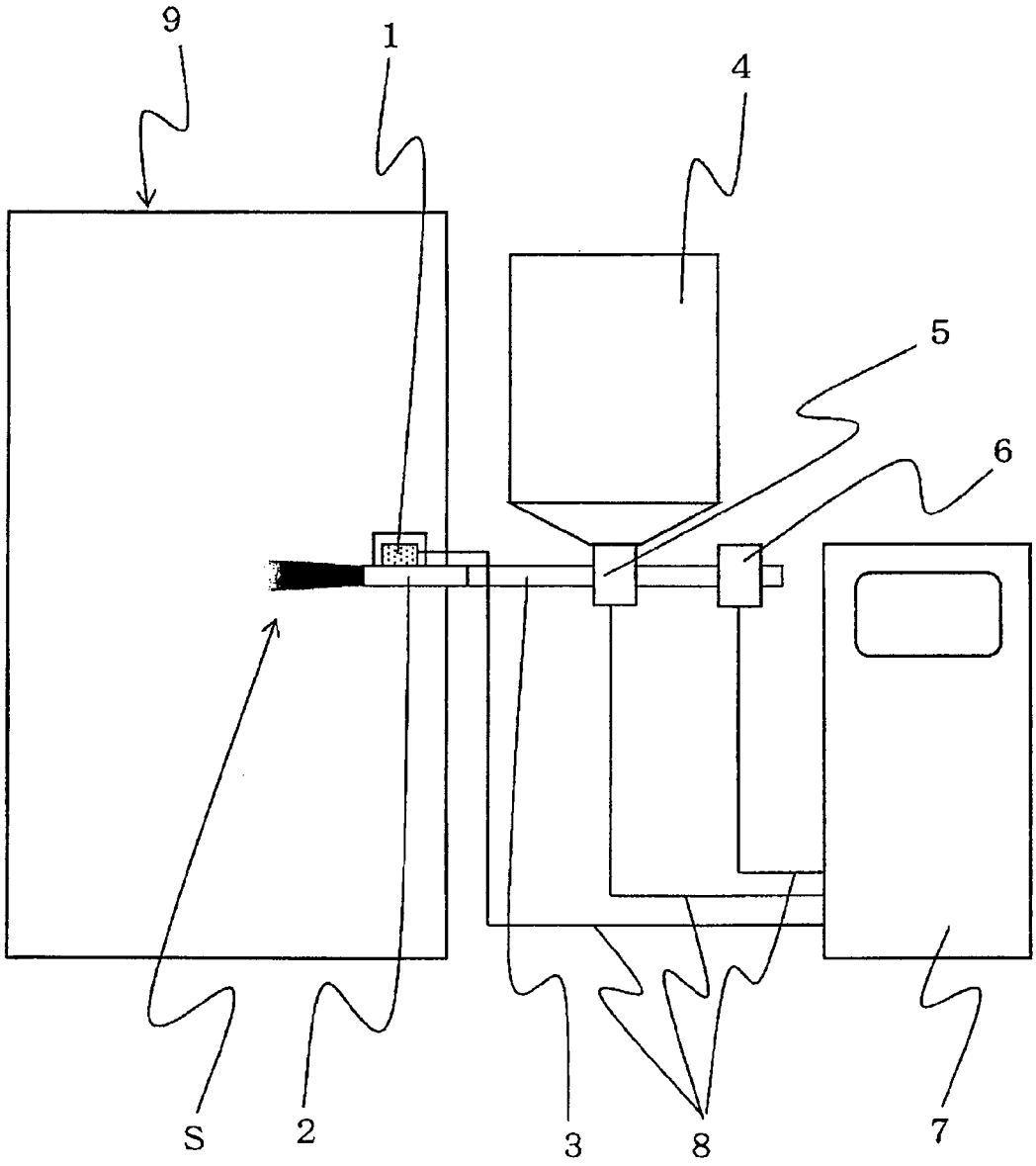
FIG. 1 is a schematic view of one embodiment of the shot-peening machine of the present invention.

Below, a method for shot peening and the machine for carrying out the method are discussed with reference to the drawings. As shown in FIG. 1, the shot-peening machine of one embodiment of the present invention comprises a storage tank 4 for shot materials, a device 5 for adjusting the amount of the materials to be shot based on the volume flow or mass flow of them, a device 6 for adjusting the pressure of the compressed air to be used for shooting the materials, a shooting nozzle 2 to shoot the materials, an AE sensor (Acoustic Emission sensor) 1 as a transducer, and a controller 7. The shooting nozzle 2 shoots the materials from the device 5 for adjusting the amount of the materials to be shot through a hose 3 as a means for transporting the materials by using the compressed air that is adjusted by the device 6 for adjusting the pressure of the compressed air. The AE sensor 1 detects the elastic waves that are generated by the shot materials that pass through the shooting nozzle 2. It transduces the elastic waves to high-frequency electrical signals, and outputs the signals. The shooting nozzle 2 is located in the shooting room 9. It processes a work (not shown) there by shot peening. The AE sensor 1, the device 5 for adjusting the amount of the materials, and the device 6 for adjusting the pressure of the compressed air, are electrically connected to the controller 7 through respective communication lines 8.

Figure 2:
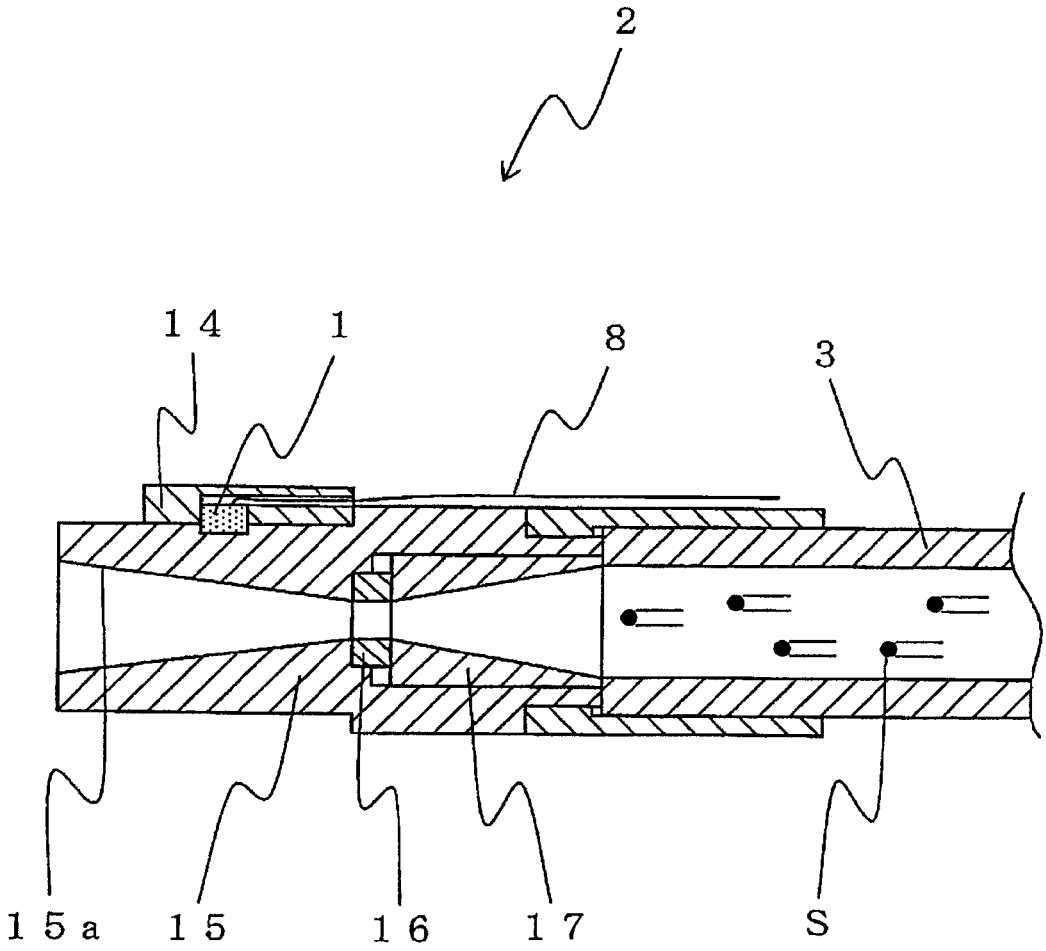
FIG. 2 is a cross sectional view of the shooting nozzle of the present invention.

As shown in FIG. 2, the shooting nozzle 2 comprises a tapered section 17, a Venturi section 16, and a tip 15. The AE sensor 1 is mounted on the outside of the tip 15 by means of a sensor holder 14, and electrically connected to the controller 7 through one of the communication lines 8. The sensor holder 14 also acts as a guard for protecting the AE sensor 1 from the shot materials S that are reflected in the shooting room 9. The tapered section 17 of the shooting nozzle 2 is connected to the hose 3.

Figure 3:
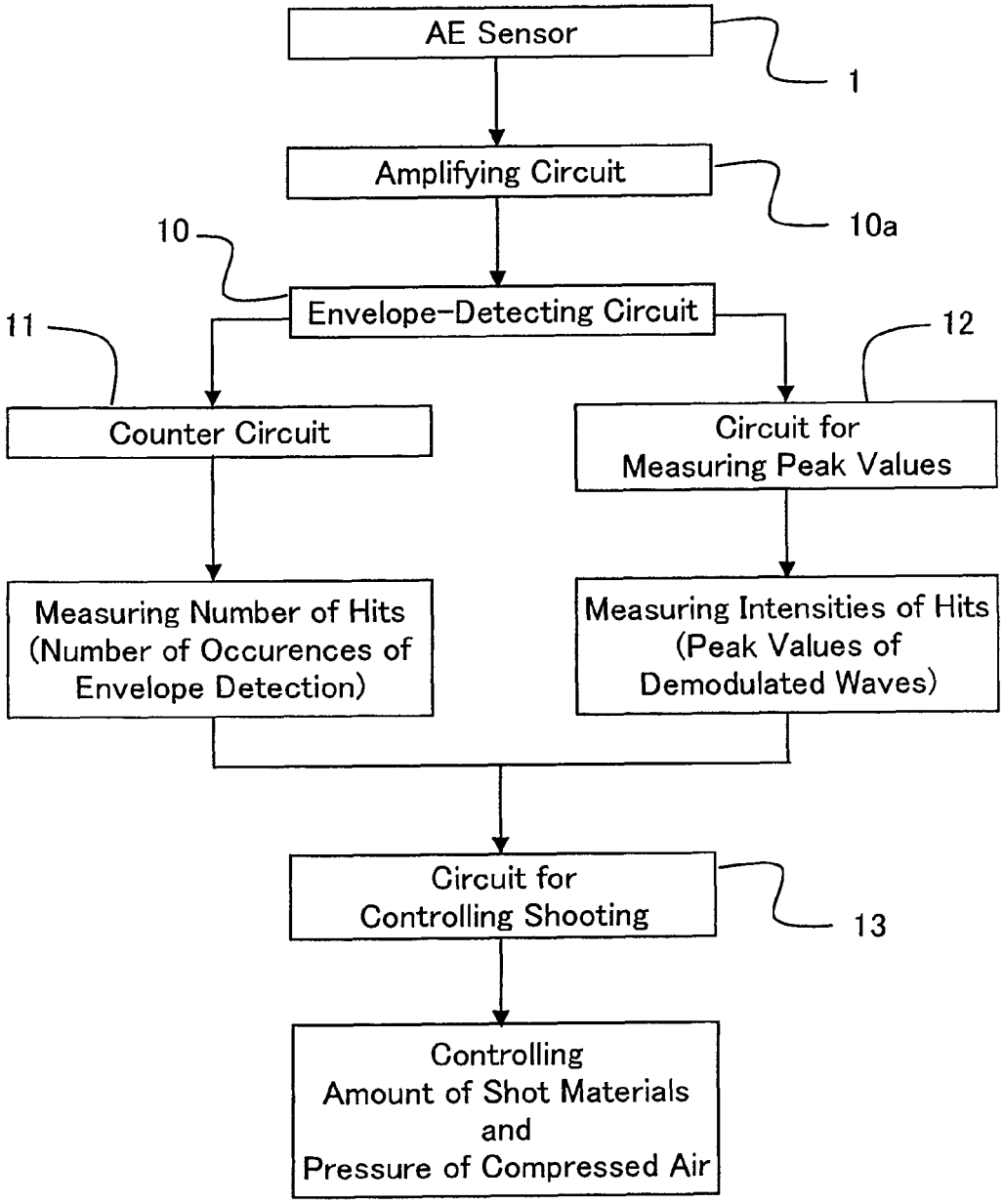
FIG. 3 is a block diagram illustrating a circuit for measuring the signals from an AE sensor and a circuit for controlling the shooting as a controlling means.

FIG. 3 is a block diagram illustrating a circuit for measuring the signals from the AE sensor 1 and a circuit for controlling the shooting as a controlling means. These circuits are located in the controller 7. The distal end of the communication line 8 is connected to an envelope-detecting circuit 10 through the amplifying circuit 10*a*. The envelope-detecting circuit 10 transduces the high-frequency electrical signals to the demodulated waves by the envelope detection. The envelope-detecting circuit 10 is connected to both a counter circuit 11 that counts the number of occurrences of the envelope detection and a circuit 12 for measuring the peak values in the demodulated waves. The number of occurrences of the envelope detection that are counted by the counter circuit 11 and the peak values in the demodulated waves that are measured by the circuit 12 correspond to the amount of the shot materials and the pressure of compressed air at which the materials are shot, respectively. Both the counter circuit 11 and the circuit 12 for measuring the peak values are connected to a circuit 13 for controlling the shooting. The circuit 13 controls the operation of the shot-peening machine based on the values that are measured by the counter circuit 11 and the circuit 12 for measuring the peak values.

The values that are measured by the counter circuit 11 and the circuit 12 for measuring the peak values indicate the conditions of the shot materials that pass through the shooting nozzle 2. The values are called the "characteristic values."

The controller 7 comprises a circuit for memorizing the characteristic values in chronological order (not shown) as a controlling means.

Further, the controller 7 comprises, as the controlling means, a circuit for comparing the characteristic values to the values that are predetermined and memorized (not shown), a circuit for judging if the characteristic values exceed the predetermined values (not shown), and a circuit for giving an alarm if a characteristic value exceeds the predetermined values (not shown).

Next, the embodiment of the present invention is discussed. However, the present invention should not be construed to be limited to the embodiment.

The shot materials S are supplied from the storage tank 4 by the device 5 for adjusting the amount of the materials to be shot. They are transported to the shooting nozzle 2 through the hose 3 by the compressed air that is supplied from an air source (not shown) and of which the pressure is adjusted by the device 6 for adjusting the pressure of the compressed air. They pass through the tapered section 17 and are accelerated in the Venturi section 16. The accelerated shot materials S with the compressed air are shot from the tip 15.

In addition, some of the accelerated shot materials S contact the inner surface 15*a* of the tip of the shooting nozzle. The elastic waves are generated by those contacts. They are detected by the AE sensor 1 and are transduced to high-frequency electrical signals. Then, the high-frequency electrical signals are output to the envelope-detecting circuit 10 through the communication line 8 and the amplifying circuit 10*a*. The high-frequency electrical signals are input to the envelope-detecting circuit 10, which outputs signals to the counter circuit 11 and the circuit 12 for measuring the peak values. Thus, the number of occurrences of the envelope detection (the number of hits) and the peak values in the demodulated waves detected by the envelope detection (the intensities of the hits) are measured.

Then, the circuit 13 for controlling the shooting, which is a controlling means, controls the device 5 for adjusting the amount of the materials to be shot and the device 6 for adjusting the pressure of the compressed air based on the measured values.

The results of the measurements of the intensities of the hits and the number of hits of the shot materials are analyzed to control the machine. If the amount of the shot materials remains constant and the number of the hits increases, then the shot materials become smaller in diameter. Thus, the supply of new shot materials is required. If the intensity of the hits is lowered and the number of hits remains normal, then it is seen that the efficiency of the acceleration is reduced due to the abrasion of the Venturi section 16, etc. Thus, the pressure of compressed air at which the materials are shot is adjusted, or an alarm signal is generated.

Since in the normal operation the intensities of the hits of the shot materials are calculated, an abnormal state, such as if the hose 3 between the device 5 for adjusting the amount of the materials and the shooting nozzle 2 becoming worn and a hole thereby being formed, can be detected. Using the characteristic values that are measured by the counter circuit 11 and the circuit 12 for measuring the peak values for controlling the device 5 for adjusting the amount of the materials to be shot and the device 6 for adjusting the pressure of the compressed air, generating an alarm, detecting a hole in the hose 3, and so on, is called "monitoring."

Since the shooting nozzle 2 is equipped with the AE sensor 1 and the characteristic values are memorized in chronological order, the processing of each work can be recorded. Thus, the requirements for tracing the works can be met.

Since the AE sensor 1 as the transducer is provided in the shooting nozzle 2, the conditions of the shot materials can be measured while they are being shot. In addition, since it is not hit by the shot materials, it can be used for the life of the shooting nozzle 2. Thus, the requirements for maintaining and calibrating it can be reduced. Further, since no shot materials S again hit the AE sensor 1 after being reflected to the sensor 1 or the work, the conditions of the shot materials S can be measured more precisely than those in the conventional machine. Since the sensor holder 14 covers the AE sensor 1 to protect it, these advantages are enhanced.

In the embodiment, the AE sensor is located in the tip 15 of the shooting nozzle 2. However, it can be located in any position, such as in the Venturi section 16 or the tapered section 17, as long as it is in a position where the elastic waves can be detected when they are generated by having the shot materials S that pass through the shooting nozzle 2 contact its inner surface.

The invention claimed is:

1. A method for shot peening by shooting shot materials with compressed air from a shooting nozzle against a work, wherein the shooting nozzle is equipped with a transducer, the method comprising detecting elastic waves and transducing them with the transducer to high frequency electrical signals, the elastic waves being generated by contacts of the shot materials with an inner surface of the shooting nozzle, the shot materials passing through the shooting nozzle, and wherein characteristic values of the shot materials that pass through the shooting nozzle are measured and monitored based on the high-frequency electrical signals, by transducing the high-frequency electrical signals to demodulated waves by an envelope detection, based on a number of occurrences of and peak values of the envelope detection.

2. The method for shot peening of claim 1, wherein the characteristic values are intensities of hits of the shot materials.

3. The method for shot peening of claim 1, wherein the characteristic values are intensities and a number of hits of the shot materials.

4. The method for shot peening of any one of claims 1-3, wherein an amount of the shot materials and pressure of the compressed air to shoot the shot materials are controlled based on the characteristic values.

5. The method for shot peening of any one of claims 1-3, wherein the characteristic values are memorized in chronological order.

6. The method for shot peening of any one of claims 1-3, wherein the characteristic values are compared to predetermined values that are preliminarily memorized, and wherein an alarm signal is generated if a characteristic value exceeds the predetermined values.

7. A shot-peening machine comprising:

a storage tank for shot materials;

a device for adjusting an amount of the shot materials to be shot;

a device for adjusting pressure of compressed air to be used for shooting the shot materials;

a shooting nozzle to shoot the shot materials by the compressed air that has been adjusted by the device for adjusting the pressure of the compressed air, the shot materials being transported from the device for adjusting the amount of the shot materials through a means for transporting the shot materials:

a transducer to transduce elastic waves to high-frequency electrical signals, the transducer being located in the shooting nozzle, the elastic waves being generated by contacts of the shot materials with an inner surface of the shooting nozzle, the shot materials passing through the shooting nozzle; and a controller being electrically connected to the transducer, to the device for adjusting the amount of the shot materials, and to the device for adjusting the pressure of the compressed air, the controller having a circuit for measuring, by transducing the high-frequency electrical signals from the transducer to demodulated waves by an envelope detection, characteristic values of the shot materials that pass through the shooting nozzle based on a number of occurrences of and peak values of the envelope detection and a controlling means for monitoring the characteristic values.

8. The shot-peening machine of claim 7, wherein the transducer is an AE sensor.

9. The shot-peening machine of claim 7, wherein the circuit for measuring has a circuit for amplifying the high frequency electrical signals, an envelope-detecting circuit for transducing the high-frequency electrical signals to demodulated waves by envelope detection, and a circuit for measuring peak values in the demodulated waves based on signals obtained by the envelope detection, the peak values being obtained as the intensities of hits.

10. The shot-peening machine of claim 9, wherein the circuit for measuring further comprises a circuit for counting a number of occurrences of the envelope detection as the number of hits of the shot materials based on the signals that are obtained by the envelope detection.

11. The shot-peening machine of claim 9, wherein the controlling means comprises a circuit for controlling the shooting that controls the amount of the shot materials and the pressure of the compressed air to shoot the shot materials based on the peak values in the demodulated waves.

12. The shot-peening machine of claim 10, wherein the controlling means comprises a circuit for controlling the shooting that controls the amount of the shot materials and the pressure of the compressed air to shoot the shot materials based on the peak values in the demodulated waves and the number of hits of the shot materials.

13. The shot-peening machine of any one of claims 9 to 12, wherein the controlling means comprises a circuit for memorizing the characteristic values in chronological order.

14. The shot-peening machine of any one of claims 9 to 12, wherein the controlling means comprises a circuit for comparing the characteristic values to predetermined values that are preliminarily memorized, a circuit for judging whether the characteristic values exceed the predetermined values, and a circuit for generating an alarm signal, based on the judgment of the circuit for judging, if a characteristic value exceeds the predetermined values.

* * * * *